US007350781B2

(12) United States Patent
Shalit

(10) Patent No.: US 7,350,781 B2
(45) Date of Patent: Apr. 1, 2008

(54) INTERACTIVE EDUCATIONAL GAME

(76) Inventor: Robyn Shalit, 27 Berkshire Dr., Princeton Junction, NJ (US) 08550

( * ) Notice: Subject to any disclaimer, the term of this patent is extended or adjusted under 35 U.S.C. 154(b) by 710 days.

(21) Appl. No.: 10/323,510

(22) Filed: Dec. 19, 2002

(65) Prior Publication Data

US 2004/0119228 A1 Jun. 24, 2004

(51) Int. Cl.
*A63F 3/00* (2006.01)

(52) U.S. Cl. ..... 273/240; 273/273

(58) Field of Classification Search ..... 273/240, 273/273; 437/188

See application file for complete search history.

(56) References Cited

U.S. PATENT DOCUMENTS 4,226,420 A * 10/1980 Corday ..... 273/269
4,306,868 A * 12/1981 Hankins ..... 434/85
4,877,253 A * 10/1989 Arens ..... 273/240
4,952,153 A * 8/1990 McAllister ..... 434/259
5,626,477 A * 5/1997 Adkison ..... 434/128

OTHER PUBLICATIONS

"The way to play" published by Diagram Group (3 pages).*

* cited by examiner

*Primary Examiner*—Vishu K. Mendiratta
(74) *Attorney, Agent, or Firm*—Lerner, David, Littenberg, Krumholz & Mentlik, LLP

(57) ABSTRACT

An interactive game for teaching children the concept of matching and the skills of writing and drawing. The game includes a plurality of game pieces having game piece indicia thereon, and at least one game board having game board indicia thereon. A player may select a game board and a game piece from the plurality of game pieces, match the game piece indicia of a selected game piece with a corresponding game board indicia. The player may then trace a symbol associated with the matched indicia within a tracing area or write or draw something associated with the matched indicia within a drawing area.

10 Claims, 4 Drawing Sheets

INTERACTIVE EDUCATIONAL GAME

BACKGROUND OF THE INVENTION

The present invention relates in general to the field of educational games. More particularly, the present invention relates to interactive children's games that allow children to learn while enjoying game play.

There are many different games that are tailored toward children. Educational games often enable children to learn while enjoying the competition of the game.

One example of a game enjoyed by both children and adults is Bingo. As is well known, Bingo provides a separate game board for each player. The game board typically includes columns of numbers beneath corresponding letters B, I, N, G and O. Game pieces are provided, each of which identify a single number. A moderator calls out numbers one at a time. The players review the numbers, which correspond to the letters on their respective game boards and if a match exists between the number that was called out and a number on a game board, the player may place a game piece on that particular number. The game may be concluded when all numbers in a particular row or column are covered by game pieces, or when all numbers on a board are covered by game pieces.

Bingo-type games for children also exist where different objects, such as animals, letters or the like are arranged in columns, which correspond to the letters B, I, N, G and O. The children's version of Bingo provides a learning opportunity for children as they identify the various letters, animals, numbers or other objects.

There are many other educational games for children, which attempt to teach children to identify letters, numbers, animals and various other objects. However, a shortcoming with all known children's games, including the games discussed above, is that they do not effectively combine object identification with the understanding of how to draw or trace the particular object. Thus, the prior art children's games do not provide an efficient interactive learning experience for children. The present invention overcomes the shortcomings in the prior art by providing a matching game for children, which includes an additional level of interactive learning experience.

SUMMARY OF THE INVENTION

A game is provided in one aspect of the present invention. The game comprises a plurality of game pieces having game piece indicia thereon. The game further comprises at least one game board having game board indicia thereon corresponding to at least one of the game piece indicia. The at least one game board has at least one drawing area in which a player may draw an object associated with the corresponding game board indicia and game piece indicia.

In a preferred embodiment, the drawing area comprises a symbol, which corresponds to one of the game board indicia. The symbol may comprise various objects including, letters, numbers, words, animals, shapes and an infinite variety of other things.

Preferably the drawing area comprises an erasable surface. A player may trace or draw an object with erasable marker on the erasable surface of the drawing area. Upon completion of the game, a player may erase the object drawn in the drawing area.

Preferably, the game further comprises a game piece holder, which is constructed and arranged to hold the plurality of game pieces. The game piece holder preferably includes an exterior surface and at least one game piece retainer arranged adjacent the exterior surface for retaining at least one game piece thereon in a position such that the game piece is visible to game players.

The game piece retainer may comprise a magnet, VELCRO, a pocket, or various other means for retaining a game piece on or adjacent to the exterior surface of the game piece holder. The game piece holder may function as a carrying case or as a centerpiece during game play.

Preferably, the at least one game board comprises a plurality of game boards. Each of the game boards may comprise a combination of game board indicia, which is different from the combination of game board indicia on other ones of the plurality of game boards. It is also preferable for the game board indicia on each of the plurality of game boards to correspond to some, but not all of the game piece indicia.

A method of playing a game is provided in accordance with another aspect of the present invention. The method comprises selecting a game piece from a plurality of game pieces, and selecting a game board from a plurality of game boards. A player would then check to determine if a match exists between the game piece indicium on the selected game piece and the game board indicia on their respective game board. If a match is found to exist, the player would draw within a drawing area on the game board something that corresponds to the indicia.

Preferably, the method further comprises associating the matched indicia with a symbol arranged on the game board which corresponds to the matched indicia. The step of drawing within a drawing area may comprise tracing the corresponding symbol on the game board.

In the embodiment where the game board comprises a plurality of symbols, each symbol would preferably correspond to a corresponding one of the plurality of game board indicia.

In accordance with a preferred method, a player is considered a winner upon matching indicia from selected game pieces with all game board indicia on his particular game board, and subsequently tracing each symbol on the game board. Alternatively, a player may simply draw an object associated with the corresponding game board and the game piece indicia within a drawing area.

After selecting game pieces, each player may place the selected game piece on a game piece retainer. The game piece retainer may have a magnetic surface arranged adjacent to the exterior surface. Each game piece may have magnetic material, or metallic material or numerous other types of fasteners to attach game piece but not limited to any specific material, arranged on the back thereof. Each game piece could then be arranged on the exterior surface of the game piece retainer and may displayed to so game players can view the game pieces on the exterior surface.

In an embodiment where the symbols in the tracing area comprise letters associated with corresponding game board indicia and game piece indicia, the step of tracing comprises tracing the letters.

It is an object of the present invention to provide a children's game, which is both educational and fun. It is a further object of the present invention to provide an interactive children's game, which facilitates the learning experience afforded to players.

The above objects, and other features and advantages of the present invention will be more clearly understood when considered in conjunction with the corresponding drawings and following detailed description and claims.

DETAILED DESCRIPTION

Figure 1:
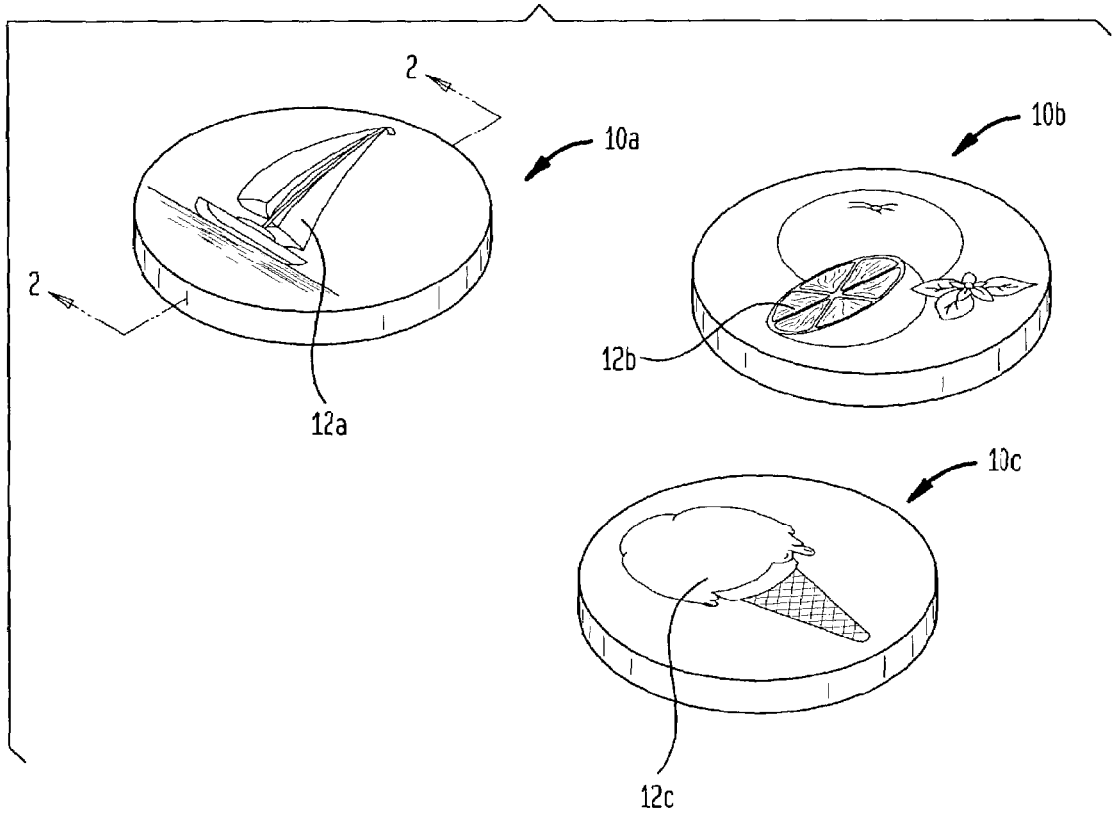
FIG. 1 is a perspective view of a plurality of game pieces of the present invention.

FIG. 1 illustrates a plurality of game pieces 10*a*-10*c* in accordance with a preferred embodiment of the present invention. Game pieces 10*a*-10*c* have corresponding game piece indicia 12*a*-12*c* thereon.

Game piece indicium 12*a* is a picture of a sailboat, 12*b* is a picture of an orange and game piece indicium 12*c* is a picture of an ice cream cone.

Figure 2:
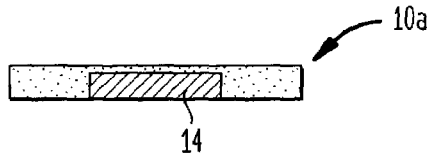
FIG. 2 is a cross-sectional view taken along line 2-2 of one of the game pieces shown in FIG. 1.

FIG. 2 is a cross-sectional view taken along line 2-2 of game piece 10*b* shown in FIG. 1. FIG. 2 illustrates that game piece 10*b* includes magnetic material 14 at the rear surface thereof. The purpose of the magnetic material 14 will be evident when discussed below in accordance with use of the present game.

Figure 3:
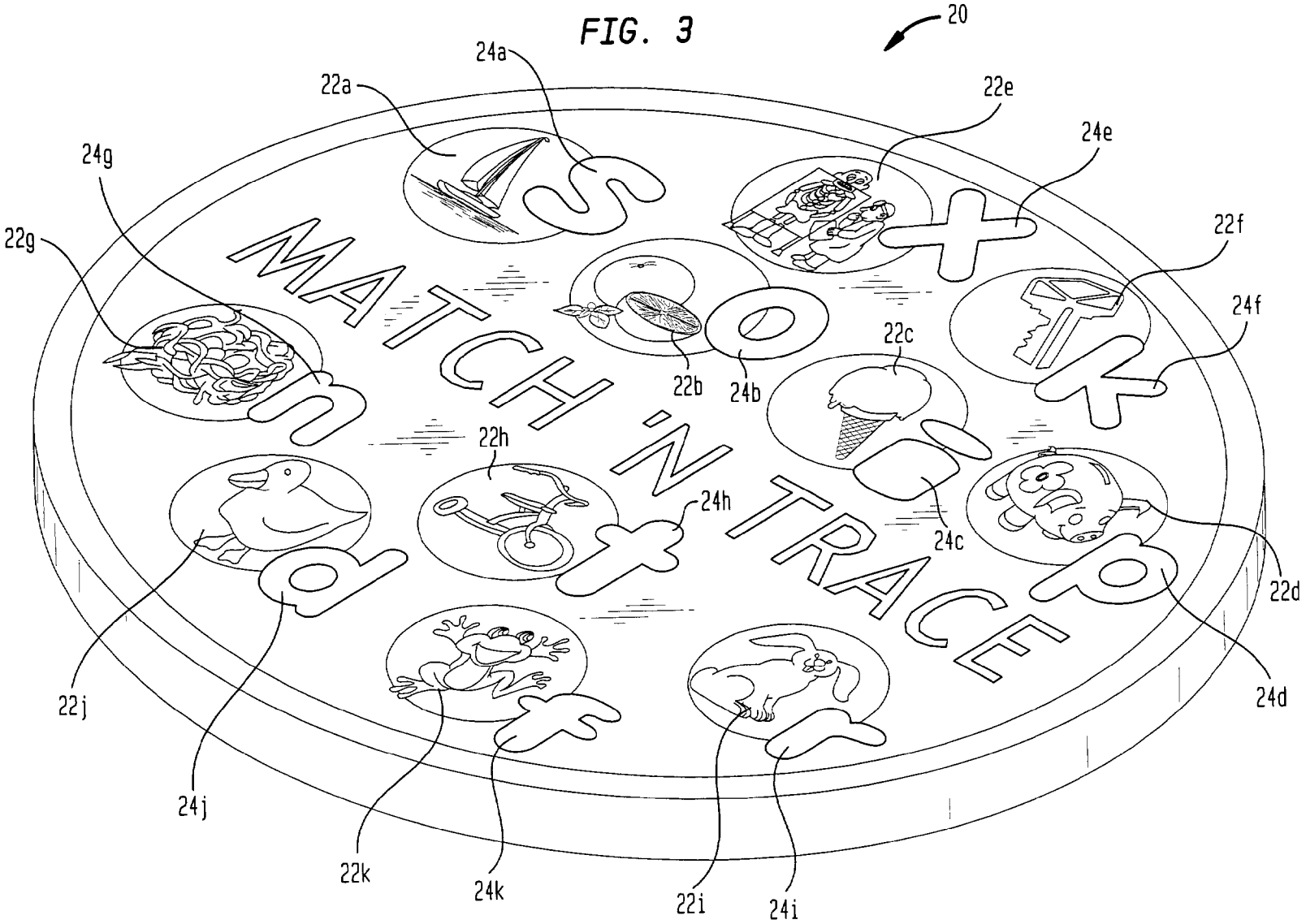
FIG. 3 is a perspective view of a game board of the present invention.

FIG. 3 illustrates one of a plurality of game boards 20 in accordance with a preferred embodiment of the present invention. Game board 20 includes a plurality of game board indicia 22*a*-22*k* thereon and corresponding drawing areas 24*a*-24*k*, which are illustrated as letters having tracing areas therein. The particular game board indicia 22*a*-22*k* and drawing areas 24*a*-24*k* thereon are as follows: 22*a* represents a sailboat and 24*a* represents the letter s, 22*b* represents an orange and 24*b* represents the letter o, 22*c* represents an ice cream cone and 24*c* represents the letter i, 22*d* represents a pig and 24*d* represents the letter p, 22*e* represents an x-ray and 24*e* represents the letter x, 22*f* represents a key and 24*f* represents the letter k, 22*g* represents a nest and 24*g* represents the letter n, 22*h* represents a tricycle and 24*h* represents the letter t, 22*i* represents a rabbit and 24*i* is shown as the letter r, 22*j* represents a duck and 24*j* represents the letter d, 22*k* represents a frog and 24*k* is shown as the letter f.

Although FIG. 1 only illustrates three examples of game pieces 10*a*-10*c*, it should be appreciated that the game of the present may comprise a larger quantity of game pieces having game piece indicia thereon than the quantity of corresponding game board indicia 22*a*-22*k* on any one game board 20.

In the embodiment shown in FIG. 3, each game board indicium 22*a*-22*k* is associated with the corresponding letters shown in the drawing (e.g. tracing) areas 24*a*-24*k*. In particular, each of the letters of tracing areas 24*a*-24*k* represents the first letter of the object shown in corresponding board game indicia 22*a*-22*k*. For example, game board indicium 22*b* illustrates oranges while the first letter in the word orange is the letter O which is illustrated at tracing area 24*b*.

While the preferred embodiment illustrates the drawing areas as "tracing areas" where a player may trace the shape of a letter (as discussed below), in alternate embodiments the drawing area may comprise an area for a player to simply draw something that corresponds with matching game board and game piece indicium.

Figure 5:
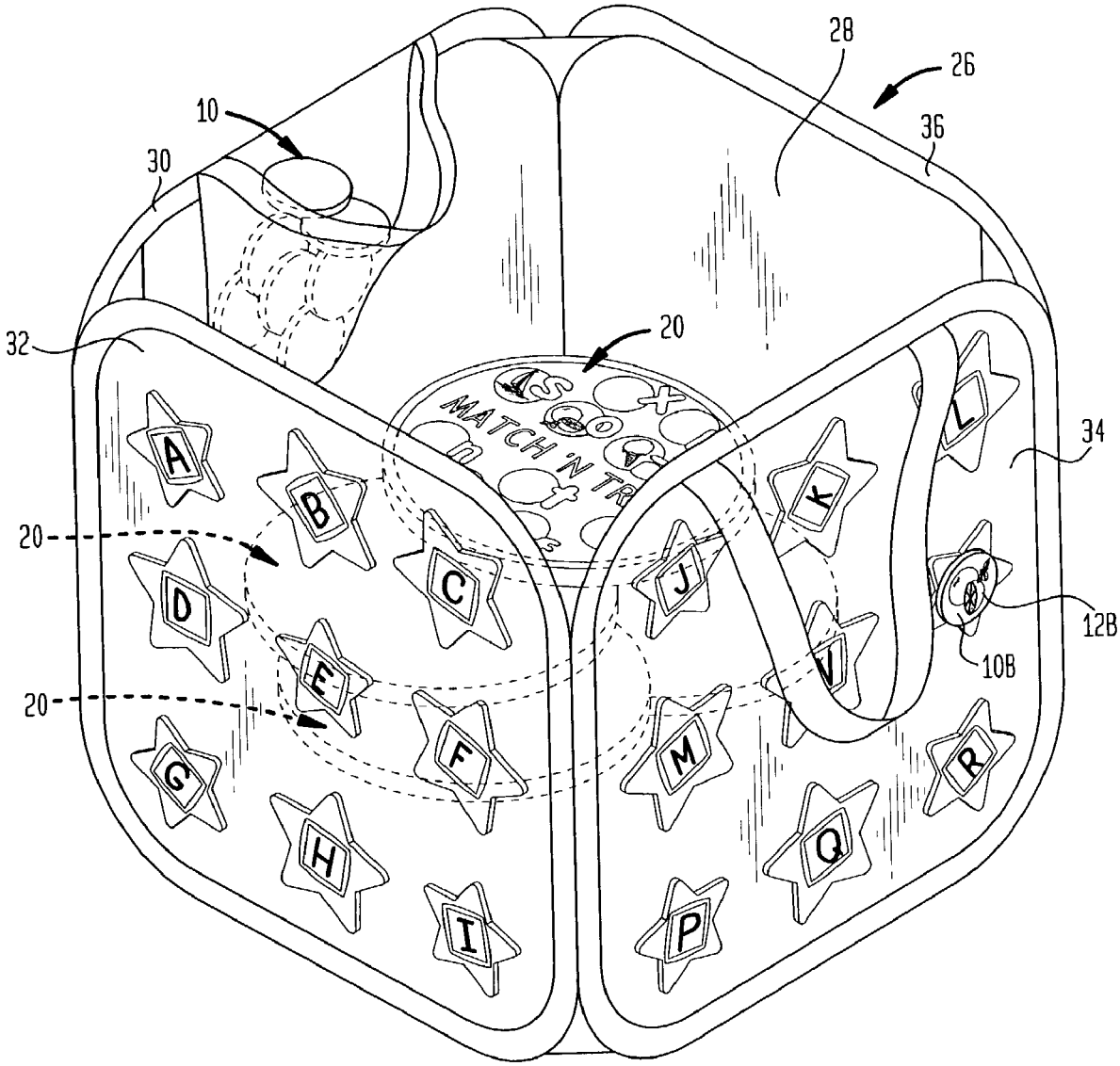
FIG. 5 is a perspective view of a game piece holder showing a game piece arranged on an external surface thereof.

As illustrated in FIG. 5, a game piece holder 26 is provided. The game piece holder 26 may serve the purpose of holding the plurality of game pieces 10 and game boards 20 in a center cavity 28 thereof. The game piece 26 may also function as a centerpiece during playing of the game as discussed below. The game piece holder 26 is shown having the shape of a cube including sidewalls 30, 32, 34 and 36 and an open top to access game pieces, game boards, markers and other game accessories from center cavity 28. In alternate embodiments, the game piece holder can be various shapes and sizes, and can be made of numerous materials.

In the embodiment shown in FIG. 5, the game piece holder 26 is adorned with the letters of the alphabet spaced along the sidewalls 30, 32, 34 and 36. The letters may be made of a magnetic or metallic material for attracting the magnetic material 14 arranged at the rear surface of each of the game pieces 10.

In accordance with a method of playing the present matching game, children will enjoy an interactive experience while learning the concepts of matching objects to each other and tracing or otherwise drawing symbols corresponding to matched objects. With reference to the drawings, the method of playing the game includes the use of the game pieces 10 and at least one of the game boards 20. The game is designed to be played by one or more players and may be particularly advantageous for a child to play it under the guidance of an adult who will reinforce the matching, associating, tracing and/or drawing skills obtained through game play. Where two or more children simultaneously play the present game, there is the added element of competition to determine which player will be the first to complete matching and tracing or otherwise drawing an associated symbol on a game board 20.

Each player selects one game board 20 from a plurality of game boards. The players may then alternate selecting game pieces 10 from a plurality of game pieces, which may be retained within the center cavity 28 of game piece holder 26. When a game piece 10 is selected, each player will consider the game piece indicium thereon and review his or her respective game boards 20 to determine whether any of the game board indicia 22 matches the game piece indicium 12. For example, if the first player selects game piece 10*b* including an orange as indicium 12*b* thereon, each player would review his or her game board 20 to determine if the game board indicium 22*b* of an orange is present. If it is, each player would then trace the letter "o" shown in tracing area 24*b*.

Figure 4:
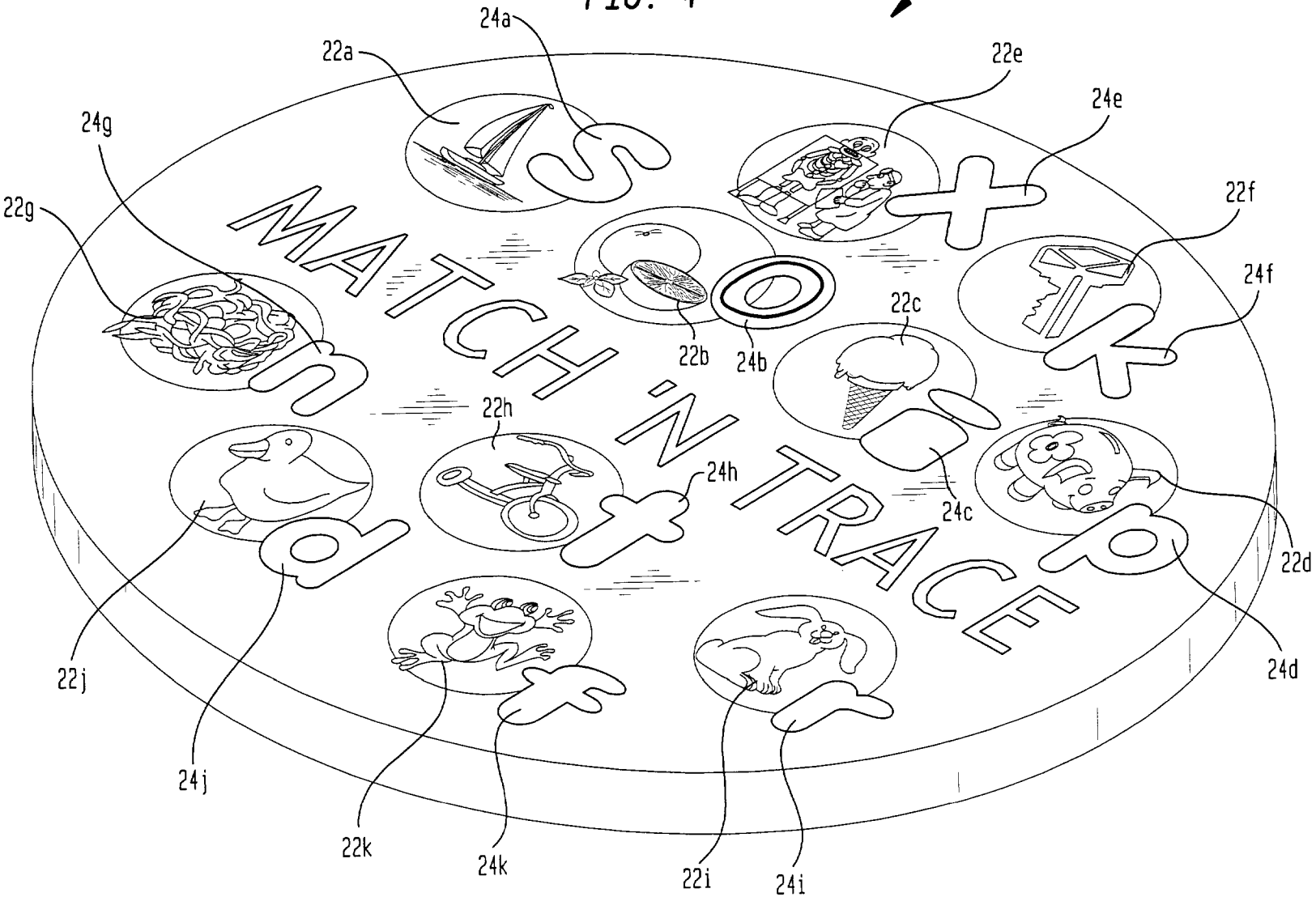
FIG. 4 is a perspective view of the game board of FIG. 3 illustrating shading within a tracing area associated with corresponding game board indicium and game piece indicium.

FIG. 4 is substantially identical to FIG. 3, except that it illustrates shading within the letter "o" at game board indicium 24*b*. This is indicative of a player tracing the outline of the letter "o" with a marker.

Preferably, tracing area 24*b* and all other tracing areas 24*a*-24*k* comprise an erasable surface so that the game can be played many times without disposing of a game board. In alternate embodiments, the game board may comprise paper, or other material, which does not include an erasable drawing area (e.g., tracing area).

As an additional tool for reinforcing that the letter "o" is the first letter in the word "orange," the player who selected game piece indicium 10*b* may then be encouraged by a supervising adult to place game piece indicium 10*b* on the corresponding letter "o" or the picture of an orange arranged on sidewall 34 of game piece holder 26. FIG. 5 illustrates such a step in playing the present game as game piece 10*b* is mounted on the letter "o" at sidewall 34 of game piece holder 26 through use of the corresponding magnetic material on the rear surface of the game piece and the magnetic material on the letter "o".

Game play continues as the next player reaches into the cavity 28 of game piece 26 and selects one of the remaining game pieces 10. The steps of playing the game are then repeated as each player reviews the indicium 12 on the respective game piece to determine if a match exists between the game piece indicium and indicia on each players' game board 20.

Game play continues until one of the players matches all game board indicia 22*a*-22*k* with game piece indicia 12 and subsequently traces all corresponding letters at tracing areas 24*a*-24*k*.

In an embodiment where a drawing area, which does not include anything to trace, is provided for a player to draw something associated with each matched game board indicium and game piece indicium, a player will be considered the winner when all game board indicia 22 on the game board 20 is matched with game piece indicia 12 and all drawing areas on the game board 20 have been completed.

In more advanced versions of the present game, the drawing areas may be entirely blank where each player will be required to draw something associated with matched indicia based on each player's own imagination. In other embodiments, the drawing area may comprise a tracing area with entire words, numbers and various other objects to be traced or drawn by a player each time a match is made between the game piece indicia 12 and the game board indicia 22.

The game piece holder 26 may function as a carrying case in which all elements of the game may be retained. For example, FIG. 5 illustrates various game boards 20 (shown in phantom) and a plurality of game pieces (also shown in phantom) within cavity 28. In a preferred embodiment, the sidewalls 30, 32, 34 and 36 may be foldable so that the game piece holder 26 may be easily made into compact carrying case. Thus, the game piece holder 26 may be considered a pop-up carrying case.

In the embodiment shown in FIGS. 1-5, each game piece 10 can be secured to portions of the sidewalls 30, 32, 34 and 36 by magnetic means. However, it should be understood that various attachment means may be provided for securing the game pieces 10 to the external sidewalls 30, 32, 34 and 36. For example, the attachment means may comprise VELCRO, pockets, adhesives, etc. Regardless of the type of attachment feature used to secure the game pieces 10 on the sidewalls 30, 32, 34 and 36, it is preferable for the game pieces to be arranged so that all players participating in the game can see the game pieces when they are secured to the sidewalls of the game piece holder.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claim is:

1. A method of playing a game including a plurality of game pieces having game piece indicia thereon, and at least one game board having game board indicia thereon which corresponds to at least of some of said game indicia, said method comprising:

a. selecting a game piece from said plurality of game pieces;

b. selecting a game board;

c. checking to determine if a match exists between said game piece indicia on said selected game piece and said game board indicia; and d. if a match is found to exist, tracing within a tracing area on said game board something that corresponds to said indicia.

2. The method of claim 1 wherein said game further comprises a game piece retainer constructed and arranged to retain said plurality of game pieces, said method further comprising attaching to an external surface of said game piece retainer, each game piece having indicia which matches game board indicia.

3. The method of claim 1 wherein the step of drawing comprises writing a word which corresponds to game piece and game board indicia within said drawing area.

4. The method of claim 1 further comprising erasing said drawing area on said game board after drawing with an erasable marker therein.

5. The method of claim 1 further comprising associating said matched indicia with a symbol arranged within said tracing area on said game board, said symbol corresponding to said matched indicia, said step of drawing in a drawing area comprising tracing said corresponding symbol on said game board.

6. The method of claim 5 wherein said game board comprise a plurality of symbols, each of said symbols corresponding to a corresponding one of said game board indicia.

7. The method of claim 6 wherein at least one game board comprises a plurality of game boards and one game board is selected by each of a plurality of players.

8. The method of claim 7 wherein a player is considered a winner by matching each game board indicium on said game board with corresponding game piece indicium and tracing each symbol on said game board.

9. The method of claim 6 wherein said plurality of symbols comprise letters associated with corresponding game board indicia and game piece indicia, said step of tracing comprises tracing said letter of one of said symbols.

10. The method of claim 9 wherein said plurality of symbols comprise numbers associated with corresponding game board indicia and game piece indicia, said step of tracing comprises tracing said number of one of said symbols.

* * * * *